US007419155B2

(12) United States Patent
Stoll et al.

(10) Patent No.: US 7,419,155 B2
(45) Date of Patent: Sep. 2, 2008

(54) DEVICE FOR SEPARATING SHEET-TYPE PRODUCTS

(75) Inventors: Rainer Stoll, Munich (DE); Alois Wagner, Olching (DE); Frank Werner, Munich (DE)

(73) Assignee: Giesecke & Devrient, GmbH, Munich (DE)

( * ) Notice: Subject to any disclaimer, the term of this patent is extended or adjusted under 35 U.S.C. 154(b) by 378 days.

(21) Appl. No.: 10/516,416

(22) PCT Filed: May 28, 2003

(86) PCT No.: PCT/EP03/05644

§ 371 (c)(1),
(2), (4) Date: Jul. 5, 2005

(87) PCT Pub. No.: WO03/101870

PCT Pub. Date: Dec. 11, 2003

(65) Prior Publication Data

US 2006/0103066 A1 May 18, 2006

(30) Foreign Application Priority Data

Jun. 3, 2002 (DE) ..... 102 24 486

(51) Int. Cl.
*B65H 3/32* (2006.01)
*B65H 3/06* (2006.01)

(52) U.S. Cl. ..... 271/131; 271/121; 271/122

(58) Field of Classification Search ..... 271/121, 271/131

See application file for complete search history.

(56) References Cited

U.S. PATENT DOCUMENTS 4,871,162 A * 10/1989 Imai et al. ..... 271/35
5,687,963 A * 11/1997 Mennie ..... 271/119
6,017,031 A * 1/2000 Oosawa et al. ..... 271/121
6,412,770 B1 * 7/2002 Demmeler ..... 271/94

FOREIGN PATENT DOCUMENTS

DE 100 08135 A1 8/2001
DE 101 05 521 A1 8/2002
EP 0 329 035 A 8/1989

* cited by examiner

*Primary Examiner*—Kaitlin S Joerger
(74) *Attorney, Agent, or Firm*—Rothwell, Figg, Ernst & Manbeck

(57) ABSTRACT

A friction wheel singler for singling bank notes includes a singler roller 1 with grooves 2, and retaining wheels 14 cooperating with the grooves 2. The retaining wheels 14 have friction areas 14*a* and sliding areas 14*b* such that both a sliding area 14*b* and a friction area 14*a* cooperate with each groove 2 of the singler roller 1. Such a friction singler is particularly suitable for longitudinal singling of narrow bank notes and prevents skewing of the sheet to be singled during the singling process.

19 Claims, 4 Drawing Sheets

DEVICE FOR SEPARATING SHEET-TYPE PRODUCTS

CROSS-REFERENCE TO RELATED APPLICATION

This application is a National Phase of International Application Serial No. PCT/EP03/05644, filed May 28, 2003.

FIELD OF THE INVENTION

This invention relates to a friction singler for singling sheet-shaped value documents, such as bank notes, checks or the like. The friction singler comprises a sheet magazine for receiving a stack of sheets, a picking device with a singler element having, for contacting and conveying the sheets to be singled from the sheet magazine, one or more friction elements with grooves extending in the transport direction of the sheets to be singled, and a retaining device which forms with the singler element a singler gap through which the sheets to be singled are conveyed out of the sheet magazine, and which has friction areas of high coefficient of friction and sliding areas of low coefficient of friction cooperating with the grooves of the singler element.

DESCRIPTION OF THE BACKGROUND ART

There are different technical concepts for singling stacks of sheets such as bank-note bundles so that the singled bank notes can be supplied to a testing sensor system which determines the authenticity, qualitative nature, denomination or other characteristic properties of the bank notes.

The present application deals with the concept of friction singlers. In a friction wheel singler, the friction elements of a singler roller for example act on the surface of a bank note of a bank-note stack, the thus contacted bank note being conveyed in a transport direction due to friction by rotation of the singler roller while the other bank notes of the bank-note stack are held back by a retaining device. The retaining device and the singler roller to this end form a singler gap through which the bank note is conveyed. The singler roller has grooves extending in the transport direction of the bank notes to be singled and capable of being slightly engaged by the retaining device. The engagement depth is adjustable.

To make sure the bank note contacted by the singler roller is conveyed and the other bank notes of the bank-note stack are held back, the singler roller must exert on the bank note in the singler gap a singling force or feed force that is greater than the retaining force exerted on the bank note by the retaining device on the opposite side of the singler gap. The retaining device can be realized for example as a retaining roller or retaining pad or runner, which can be mounted either rigidly or so as to rotate against the transport direction.

To adjust the ratio of feed force to retaining force to a desired fixed value, the singler roller can be provided with friction elements whose friction linings have a considerably higher coefficient of friction than the corresponding friction linings of the retaining device, the ratio of friction being for example about 2:1.

It has proved disadvantageous in this procedure that the different friction materials of the singler roller and the retaining device partly have very different operating behavior, for example with respect to resistance to environmental influences, moisture absorption, temperature coefficient, aging and wear resistance. This can lead to different service lives and influences the ratio of friction, which can lead to singling errors including a multiple pick, by which more than one sheet is grasped and conveyed by the singler roller.

For avoiding these problems, a friction wheel singler was developed wherein the same friction material, or friction material with the same coefficient of friction, is used for singler roller and retaining device (DE 100 08 135 A1). To make sure the singler roller force acting on the sheet material to be singled is sufficiently greater than the force exerted by the retaining device despite the use of substantially the same friction material for retention and singling, it is provided that the contact area between the sheet material and the friction elements of the singler roller is substantially greater than the contact area between the sheet material and the friction areas of the retaining device. This is obtained by the retaining roller engaging adjacent circumferential grooves of the singler roller alternately with a material of high coefficient of friction ("friction area") and with a material of low coefficient of friction ("sliding area"). If the coefficient of friction of the sliding areas of the retaining device is negligibly low, a ratio of coefficients of friction of about 2:1 again results because the friction materials of the retaining device and the singler roller are otherwise the same.

The friction wheel singler according to DE 100 08 135 A1 is particularly suitable for transverse singling of bank notes, by which bank notes are singled with their longitudinal edge leading. When the friction wheel singler is used as a longitudinal singler, by which bank notes are singled with their narrower transverse edge leading, bank notes are occasionally skewed during singling, however, which can lead to jamming in the singler gap or to a jam in the subsequent transport path.

SUMMARY OF THE INVENTION

The problem of the present invention is to propose a friction singler of the type stated at the outset for singling sheet material, in particular for bank notes, which reduces the problem of skewing of the sheet material during singling, in particular when the friction singler is used as a longitudinal singler.

This problem is solved by a friction singler with the features disclosed herein. Advantageous embodiments and developments of the invention are also disclosed herein.

It is therefore provided that a groove of the singler element cooperates both with a friction area and with a sliding area of the retaining device. In the prior art, each groove cooperates either with a friction area or with a sliding area of the retaining device. It is suspected that the known design leads during singling of a bank note to a torque acting on the bank note when the bank note is transported for example only over two grooves of the singler element. Then only a friction area of the retaining device acts on the bank note with the first groove and a sliding area thereof with the second groove in different places. If the feed force responsible for transporting the bank note does not act on the middle of the bank note, it causes a torsional moment which cannot be compensated by the only effective friction area. This torsional moment is held responsible for the abovementioned skew and jamming of sheet material in the singler gap.

Since it is now provided that at least one, preferably at least two, of the grooves of the singler element cooperate both with a friction area and with a sliding area of the retaining device, a frictional guide of the sheet material over two grooves is achieved while the frictional contact surface or the feed force is the same, thereby reducing the danger of skewing of the sheet material.

The order of friction and sliding areas cooperating with the individual grooves can be different for different grooves, viewed transversely to the transport direction, and is preferably opposite for adjacent grooves. In the last-named case the torques acting on the transported sheet material in each groove substantially cancel each other out through the torque produced in the adjacent groove and acting in the opposite direction, thereby additionally improving the guide properties of the friction singler.

The retaining device is preferably formed by one or more retaining wheels which have the friction and sliding areas. This is advantageous in particular when the singler element is also formed as a rotating singler roller, thereby keeping the rubbing wear on the individual components low.

BRIEF DESCRIPTION OF THE DRAWINGS

The invention will hereinafter be described by way of example with reference to the attached drawings, in which.

DETAILED DESCRIPTION OF THE INVENTION

Figure 1:
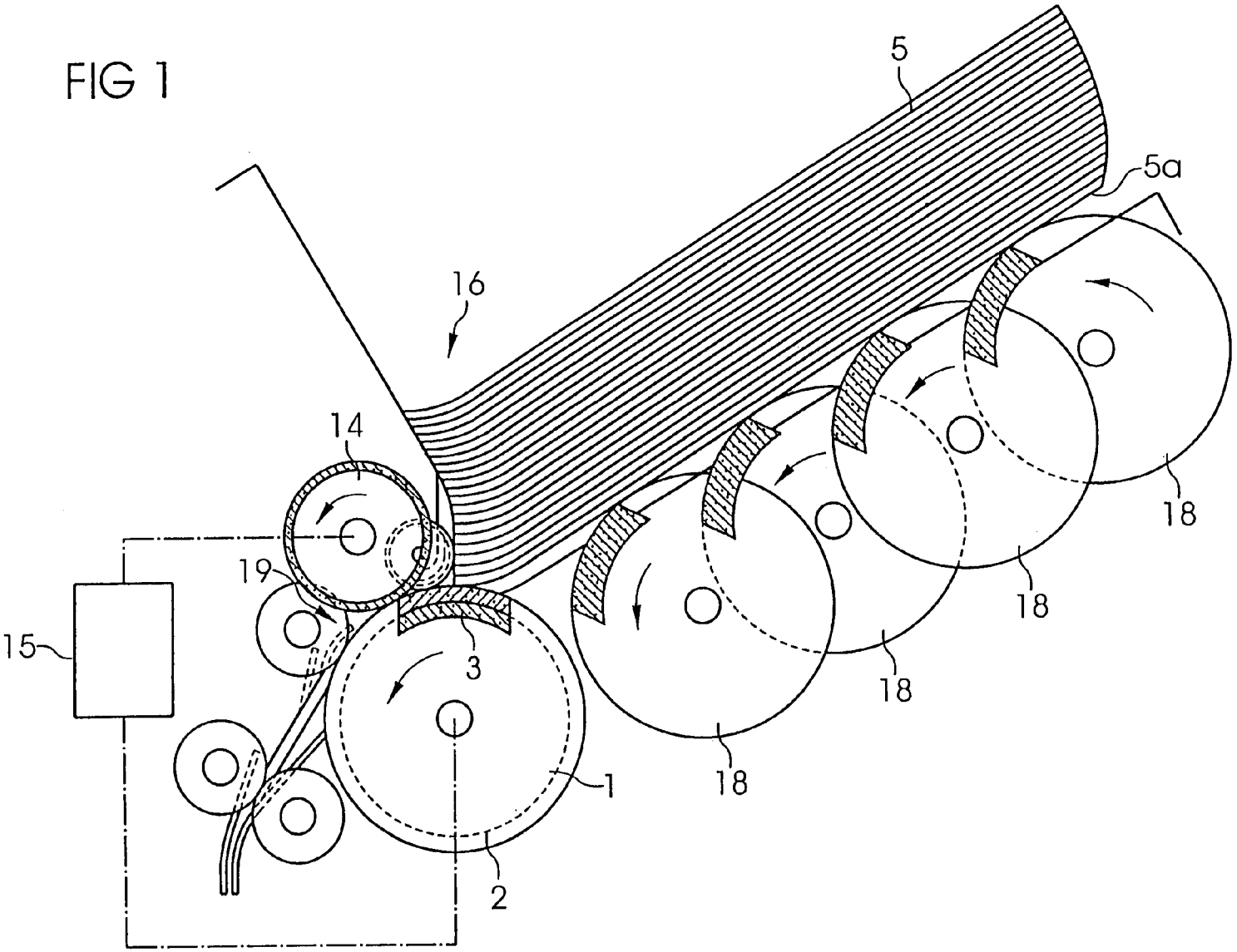
FIG. 1 shows schematically a cross section of a friction wheel singler along the singling direction of the bank notes.

The friction wheel singler according to FIG. 1 is constructed substantially as described in DE 100 08 135 A1. Therefore a detailed description of these per se known components will be omitted here.

In particular, the singler roller 1 and the retaining roller 14, as known in the art, have circumferential grooves 2 which are mutually offset and adapted in their width such that the retaining rollers 14, which are formed to be adjustable in height, can engage the grooves of the singler roller 1 to increase the frictional forces.

Figure 2:
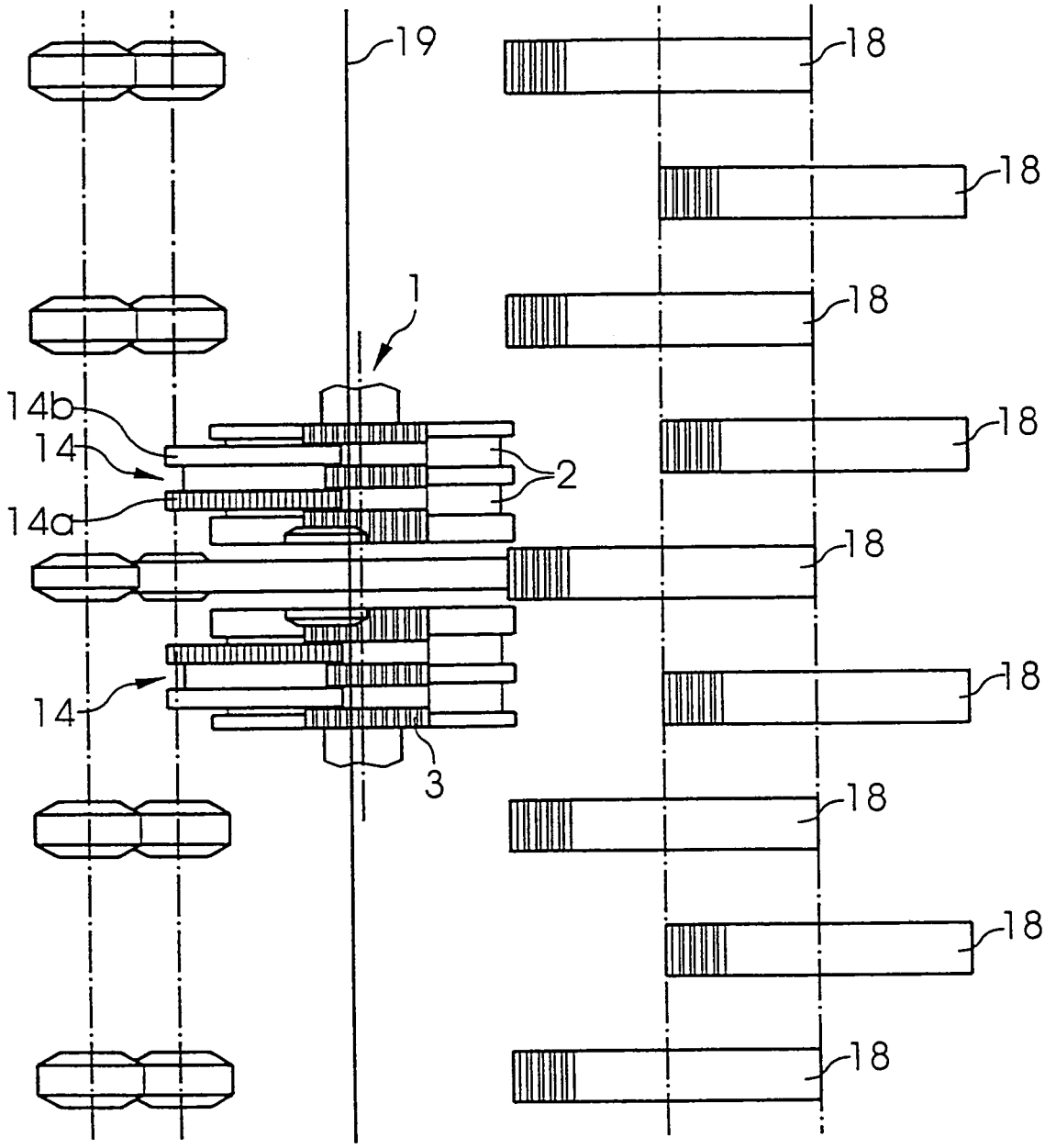
FIG 2 Prior Art
FIG. 2 shows the friction wheel singler from FIG. 1 schematically in a plan view according to the prior art.

This is shown in a plan view in FIG. 2 by the example of a friction wheel singler according to the prior art. Two retaining rollers 14 each have a frictional friction area 14*a* and a smooth sliding area 14*b* of approximately equal size. With the friction areas 14*a* and sliding areas 14*b* the retaining rollers 14 engage the circumferential grooves 2 of the singler roller 1. When the lowermost bank note 5*a* of the bank-note stack 5 is singled there are thus in each case two linear contacts of the bank note 5*a* between the retaining rollers 14 and the singler roller 1 in each circumferential groove 2. Depending on whether a contact with a friction area or a contact with a sliding area is involved, the terms "friction edge" or "sliding edge" are also used.

Because of its division into friction areas 14*a* and sliding areas 14*b*, the retaining roller 14 exerts only half as much frictional force on the bank note 5*a* to be singled as the friction segment 3 of the singler roller 1, which consists of the same friction material as the friction areas 14*a* of the retaining roller 14. A suitable friction material is in particular cast polyurethane. In contrast, the singler roller 1 is otherwise made of a synthetic material of low coefficient of friction just like the sliding areas 14*b* of the retaining wheel 14.

Singling of the bank-note stack 5 placed in the input pocket 16 of the friction wheel singler takes place as follows: the lowermost bank note 5*a* next to be singled lies with its leading edge against the singler roller 1. The force with which the bank-note stack 5 deposited in the sheet magazine 16, formed here as an oblique guiding plate, acts on the singler roller 1 is determined alone by gravity and therefore depends on the weight and thus substantially on the height of the bank-note stack 5.

With the help of the feed rollers 18 likewise equipped with friction segments, the bank notes are pushed to the singler gap 19 preferably at a speed corresponding to the transport speed of the bank note after singling has taken place. The singler gap 19 is formed by the opposing surface areas of the singler roller 1 and the retaining roller 14.

When the singler roller 1 has rotated under the control of the adjusting device 15 so far that the area of the friction segment 3 is rotated into an effective position, that is, into the area of the singler gap 19, the feed force considerably outweighs the retaining force, so that a sheet 5*a* to be singled is conveyed through the singler gap 19. When the friction segment 3 moves out of the area of the singler gap 19 in the course of further rotation of the singler roller 1, the next waiting bank note is held back until the friction segment 3 of the singler roller takes effect on the singler gap 19 again.

FIG. 2 shows the friction wheel singler with two retaining rollers 14 formed according to the prior art. Upon transverse singling, by which bank notes lie with their broader longitudinal edges against the singler gap 19, both retaining rollers 14 act on the sheet 5*a* to be singled. A torque exerted on the bank note by one retaining roller is compensated by the other retaining roller. Upon singling in the longitudinal format, by which bank notes lie with their narrower transverse edge against the singling gap 19, however, it can happen that bank notes lie only against one of the two retaining rollers 14. Since the thereby acting feed force will not act on the middle of the bank note to be singled, said roller 14 exerts on the bank note in addition to the feed force a torque perpendicular to the feed direction, which in this case is not compensated by a second retaining roller. Thus, the bank note can be jammed in the singler gap 19 or therebehind.

Figure 3:
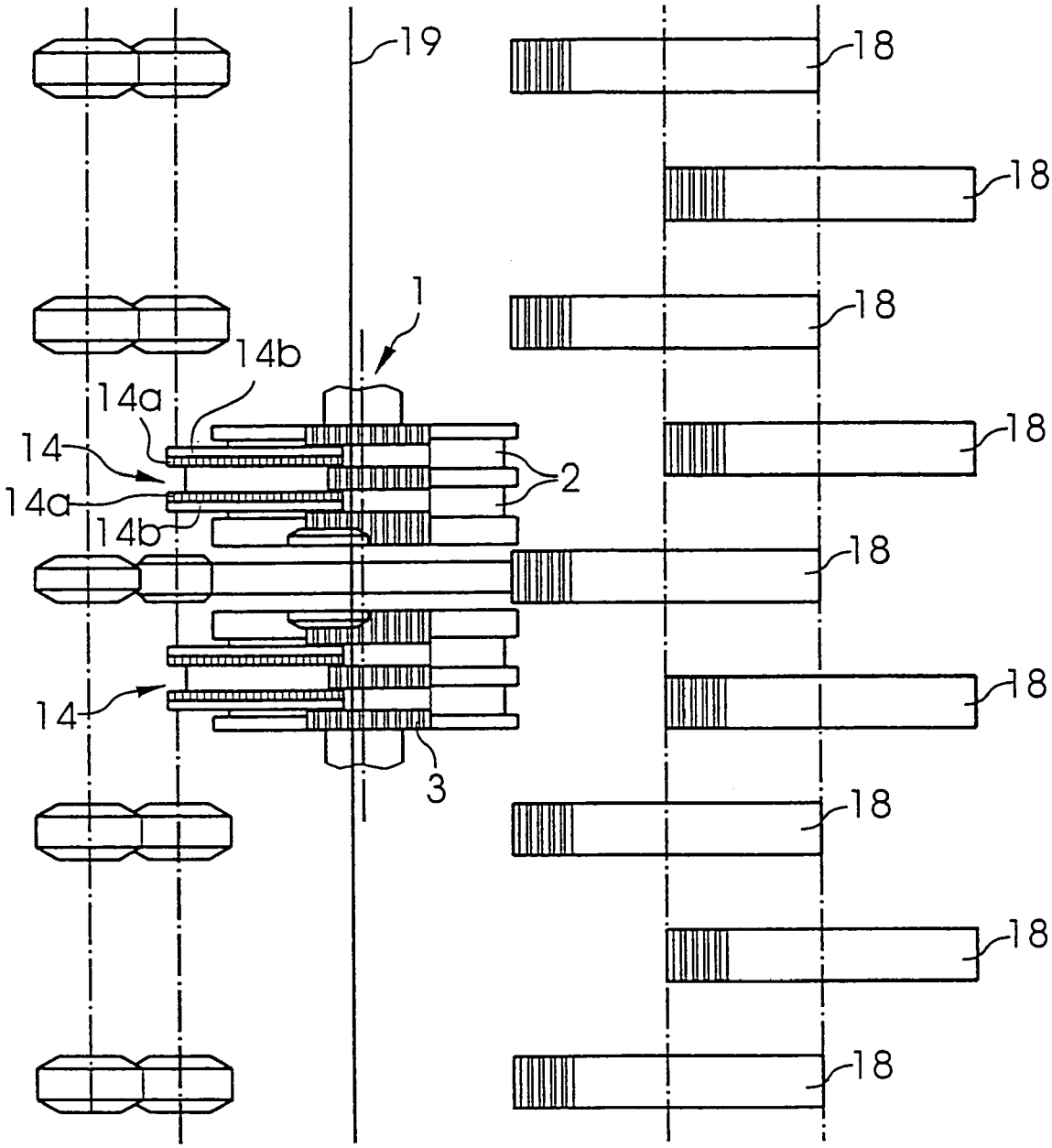
FIG. 3 shows the friction wheel singler from FIG. 1 schematically in a plan view according to the invention.

FIG. 3 shows a schematic view of the friction wheel singler as in FIG. 2 but with retaining rollers 14 modified according to the invention. Accordingly, the retaining rollers 14 still have both friction areas 14*a* and sliding areas 14*b*, but the retaining rollers 14 engage each groove 2 of the singler roller 1 both with a friction area 14*a* and with a sliding area 14*b*, so that they form both a friction edge and a sliding edge with each groove 2.

Figure 4A:
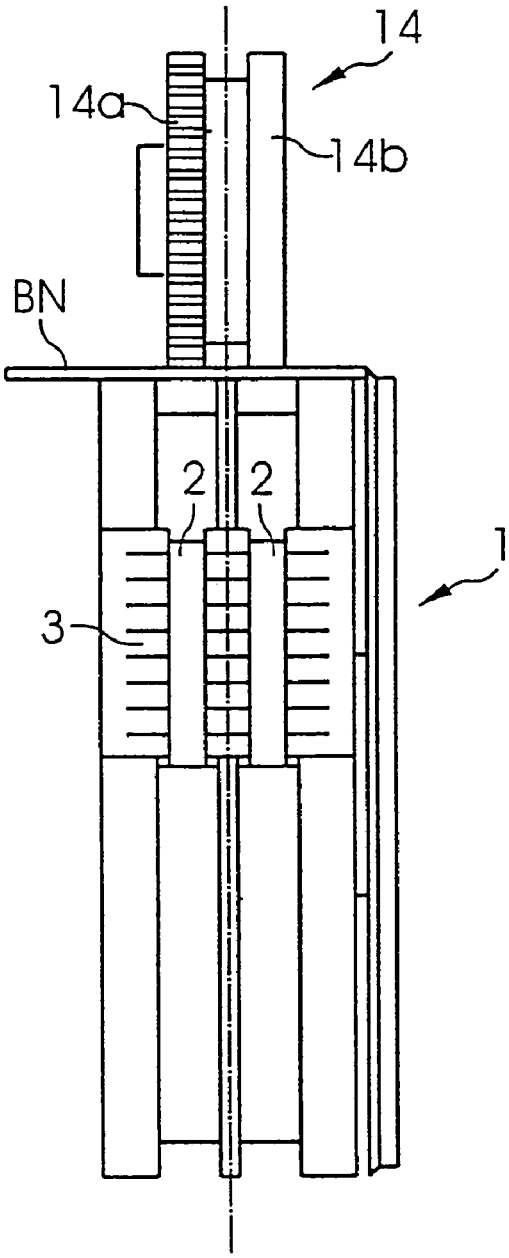
FIG 4A Prior Art
FIG. 4*a* shows a detail of a front view of the friction wheel singler as in FIGS. 1 and 2 according to the prior art.
Figure 4B:
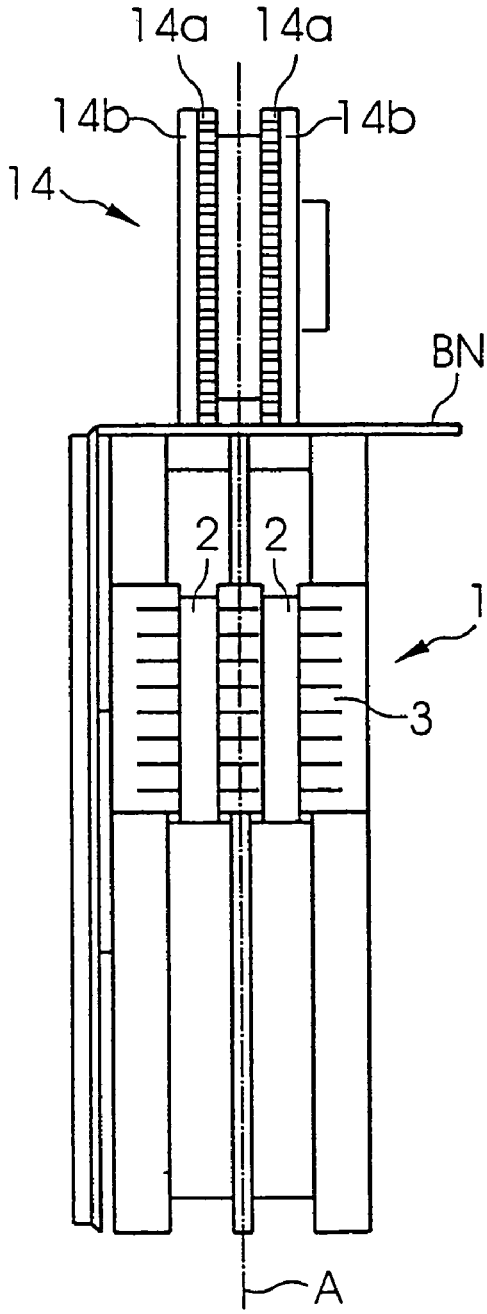
FIG. 4*b* shows a detail of a front view of the friction wheel singler as in FIGS. 1 and 3 according to the present invention.

This is presented in detail again in FIG. 4*b* in comparison with the prior art according to FIG. 4*a*, whereby FIGS. 4*a* and 4*b* each show only a singler roller 1 with two circumferential grooves 2 and a retaining roller 14 with friction areas 14*a* and sliding areas 14*b* cooperating with the circumferential grooves 2 of the singler roller 1.

While the retaining roller 14 according to the prior art as in FIG. 4*a* has a single friction area cooperating with one of the two circumferential grooves 2 of the singler roller 1 and a single sliding area 14*b* cooperating with the other of the two circumferential grooves 2 of the singler roller 1, the friction areas 14*a* and sliding areas 14*b* in the retaining roller 14 according to the invention as in FIG. 4*b* are divided up so that both a friction area 14*a* and a sliding area 14*b* of the retaining roller 14 cooperate with each circumferential groove 2 of the singler roller 1. In contrast to the prior art, in which the retaining roller 14 forms either two sliding edges or two friction edges with each of the circumferential grooves 2 of the singler roller 1, the inventive retaining roller 14 thus forms a sliding edge and a friction edge with each circumferential groove 2 of the singler roller 1. Thus, any torque acting perpendicular to the transport direction of the bank notes BN is compensated: when the order of sliding edge/friction edge is reversed with circumferential grooves 2 adjacent to each other, the produced torque is exactly balanced with respect to the central plane A located between the circumferential grooves.

LIST OF REFERENCE SIGNS

1 Singler element, singler roller
2 Groove, circumferential groove
3 Friction element
5 Stack of sheets
5*a* Sheet to be singled
14 Retaining device, retaining roller
14*a* Friction area
14*b* Sliding area
15 Adjusting device
16 Sheet magazine
18 Feed roller
19 Singler gap
A Central plane
BN Bank note

The invention claimed is:

1. A friction singler for singling sheet-shaped value documents (5), comprising:

a sheet magazine (16) for receiving a stack of sheets (5), a picking device with a singler element (1), the singler element having, for contacting and conveying the sheets (5*a*) to be singled from the sheet magazine (16), one or more friction elements (3) with at least one groove (2) extending in the transport direction of the sheets (5*a*) to be singled, and a retaining device (14) which forms with the singler element (1) a singler gap (19) through which sheets (5*a*) to be singled are conveyed from the sheet magazine (16), and which has friction areas (14*a*) of high coefficient of friction and sliding areas (14*b*) of low coefficient of friction cooperating with the at least one groove (2) of the singler element (1), characterized in that the at least one groove (2) of the singler element (1) cooperates both with a friction area (14*a*) and with a sliding area (14*b*) of the retaining device (14).

2. A friction singler according to claim 1, characterized in that the singler element (1) has at least two grooves (2), extending in the transport direction of the sheets (5*a*) to be singled, and that each cooperates both with a friction area (14*a*) and with a sliding area (14*b*) of the retaining device (14).

3. A friction singler according to claim 2, characterized in that the order of friction and sliding areas (14*a*, 14*b*) cooperating with the grooves (2), viewed transversely to the transport direction, is different for different grooves (2).

4. A friction singler according to claim 3, characterized in that the order is opposite for adjacent grooves (2).

5. A friction singler according to claim 1, characterized in that the retaining device (14) comprises one or more retaining wheels having the friction areas (14*a*) and sliding areas (14*b*).

6. A friction singler according to claim 1, characterized in that the singler element (1) is a singler roller.

7. The friction singler of claim 1, wherein said documents are bank notes.

8. The friction singler of claim 2, wherein said at least two grooves include all grooves.

9. A friction singler according to claim 2, characterized in that the retaining device (14) comprises one or more retaining wheels having the friction areas (14*a*) and sliding areas (14*b*).

10. A friction singler according to claim 3, characterized in that the retaining device (14) comprises one or more retaining wheels having the friction areas (14*a*) and sliding areas (14*b*).

11. A friction singler according to claim 4, characterized in that the retaining device (14) comprises one or more retaining wheels having the friction areas (14*a*) and sliding areas (14*b*).

12. A friction singler according to claim 7, characterized in that the retaining device (14) comprises one or more retaining wheels having the friction areas (14*a*) and sliding areas (14*b*).

13. A friction singler according to claim 8, characterized in that the retaining device (14) comprises one or more retaining wheels having the friction areas (14*a*) and sliding areas (14*b*).

14. A friction singler according to claim 2, characterized in that the singler element (1) is a singler roller.

15. A friction singler according to claim 3, characterized in that the singler element (1) is a singler roller.

16. A friction singler according to claim 4, characterized in that the singler element (1) is a singler roller.

17. A friction singler according to claim 5, characterized in that the singler element (1) is a singler roller.

18. A friction singler according to claim 7, characterized in that the singler element (1) is a singler roller.

19. A friction singler according to claim 8, characterized in that the singler element (1) is a singler roller.

* * * * *